United States Patent [19]

Matin et al.

[11] Patent Number: 4,980,977

[45] Date of Patent: Jan. 1, 1991

[54] SAFETY CORE CUTTING KNIFE

[75] Inventors: Barry D. Matin, Kent; Ellwood R. Pelton, Seattle; George E. Trepus, Jr., Enumclaw, all of Wash.

[73] Assignee: The Boeing Company, Seattle, Wash.

[21] Appl. No.: 462,923

[22] Filed: Jan. 12, 1990

Related U.S. Application Data

[63] Continuation of Ser. No. 132,439, Dec. 14, 1987, abandoned.

[51] Int. Cl.[5] ..... B26B 29/00; B26B 3/06; B67B 7/00

[52] U.S. Cl. ..... 30/286; 30/2; 30/151; 30/295

[58] Field of Search ..... 30/2, 143, 151, 164, 30/284, 285286, 295, 344, 143, 151, 286, 288

[56] References Cited

U.S. PATENT DOCUMENTS

| | | | |
|---|---|---|---|
| 365,714 | 6/1887 | Warner | 30/286 |
| 1,843,535 | 2/1932 | Arnold | 30/2 |
| 2,122,263 | 6/1938 | Pinter | 30/286 X |
| 2,644,230 | 7/1953 | Anderson | 30/2 X |
| 3,184,843 | 5/1965 | Lurie | 30/2 |
| 4,091,537 | 5/1978 | Stevenson | 30/151 X |
| 4,531,286 | 7/1985 | Vito et al. | 30/286 X |

FOREIGN PATENT DOCUMENTS

| | | | |
|---|---|---|---|
| 1281640 | 12/1961 | France | 30/286 |
| 1506572 | 4/1978 | United Kingdom | 30/286 |

*Primary Examiner*—Douglas D. Watts
*Assistant Examiner*—Paul M. Heyrana
*Attorney, Agent, or Firm*—C. O. Gardner; B. A. Donahue

[57] ABSTRACT

A knife for cutting honeycomb core and other materials with a combination of safety features to prevent or minimize injury to operator. The blade used has a hole through which a fastening device e.g. threaded screw, locks it to a handgrip. A safety guard covers the blade when not in use and automatically retracts as the blade is removed from the workpiece. The guard cannot be accidently displaced from the blade. It must be purposely unlocked by a manually triggered self-locking release assembly located in the handgrip which also automatically relocks the safety guard when retracted. The safety features consist of an automatically retractable guard attached to a safety handshield working in conjunction with the safety self-locking release assembly to prevent accidental release. Embodiments include (1) wherein the guard is opaque and has viewing ports and is hinged mechanically with springs, supports, and spacers, (2) wherein the guard is transparent eliminating the need for viewing ports, (3) wherein the guard and many other metal components are comprised of plastic, (4) wherein the guard is transparent and is hinged by an integrally molded component, (5) wherein the guard is hinged by a combination of mechanical (1) and integrally molded (4) means and (6) wherein a disposable blade is used.

1 Claim, 7 Drawing Sheets

13
8
13
27
26
23
12a
25
3
5
16
12
4
26a
6
24
10
21
9
11
11a
32
33
7
7a
31
28
31
29
22
15
30
20
17
19
18
14
14
1
1
2
2

SAFETY CORE CUTTING KNIFE

This is a continuation of copending application Ser. No. 07/132,439 filed on Dec. 14, 1987, abandoned Jan. 12, 1990.

BACKGROUND OF THE INVENTION

1. Field of the Invention

This invention consists of a knife with a unique combination of safety features to minimize and prevent puncture and laceration wounds to the user. It was specifically designed for cutting honeycomb core used in the fabrication of reinforced plastic composite structures. Embodiments of the invention provide for cutting of other materials e.g. rubber slabs, foam, plastic, livestock products, vegetables and other food.

2. Description of the Prior Art

A variety of implements are currently used for cutting honeycomb core, e.g., sharpened putty knives, straight edge blades, e.g. electric carving knife blades, also, general utility knives, and jackknives.

Currently used implements for this application are dangerous and inflict severe punctures and lacerations to the hand and other body parts. Deep blood vessels and nerves can be seriously damaged. The resultant affect to industry, business and the domestic front is costly due to such factors as time loss, decreased productivity, increased operating expenses, etc.

The frequency of injury may be reduced by implementation of protective sheaths (e.g. for putty knife and straight edge blades) or by handles into which the blades may be manually folded or retracted (e.g. jackknives or general utility knives). The value of such safety features is minimal, however, because implementation is limited to non-productive times and because operators tend to avoid their use. A knife can be designed with an automatically retractable guard as its sole protective feature, but it also is dangerous because the same retractability feature can cause it to open automatically as well, thus exposing the blade when not expected by the operator.

It should again be noted that cutting implements currently used for sectioning honeycomb core are dangerous to use. Prior art safety measures are not production effective and/or depend upon operator implementation.

The invention herein described overcomes these problems and automatically supplies the safety which is needed at all times by combining an automatically retractable guard with a manually triggered, automatically retractable, self-locking release assembly.

SUMMARY OF THE INVENTION

Embodiments of this invention comprise the following: blade, handgrip assembly for supporting the blade and manipulating the overall knife; handshield (or hilt) to prevent the hand from slipping towards the blade; and automatically retractable guard assembly which locks shut when the knife is not in use. The blade is thereby automatically covered and prevents contact with the hand or other body parts. When the guard is manually unlocked the knife can be guided over the workpiece, via guard flanges, allowing penetration of the blade into and through the workpiece. The blade is not exposed to lacerate the body parts. As the blade emerges from the workpiece, the guard automatically retracts and covers the blade again preventing contact with the hand or other body parts. Once the guard is shut it is automatically locked into that position. Also included is a manually triggered, automatically retractable, self-locking assembly to release the guard for cutting and then to automatically lock it shut when automatically retracted to its closed position. The blade, therefore, cannot be exposed accidentally to cause injuries. It necessitates the willful operation of said self-locking release assembly. Guard flanges provide a dual function, (1) positioning the knife level with the surface of the workpiece and maintaining it level with this surface while cutting and (2) preventing the opposite hand and fingers from getting into the cutting path. Embodiments of this invention include flanges which are somewhat narrower in the flat dimension in order to cut curved configurations. Additional embodiments include flanges wherein the forward flat ends are curved upward to allow initial piercing of the core.

A unique feature of the present knife is the combination of an automatically retractable safety guard assembly coupled with an automatically, self-locking manual release assembly which prevents accidental release of the guard. The knife may be fabricated entirely out of metal (first embodiment), the guard may be fabricated out of a transparent plastic guard (second embodiment) thus eliminating the need for viewing ports to observe the workpiece and cutting motion. Many of the parts may be fabricated from plastic materials with the guard transparent and the remaining parts either transparent, translucent or opaque (third embodiment). A fourth embodiment includes a guard with integral hinge, fabricated from a transparent plastic. This permits simplification of design, fabrication and usage by eliminating the mechanical, spring hinge.

BRIEF DESCRIPTION OF THE DRAWINGS

FIGS. 1*a*–7*a* are second embodiment illustrations with transparent plastic safety guard instead of the opaque metal guard with viewing ports.

Illustrations are not provided for third embodiment configurations as they consist of a variety of combinations of first and second embodiment elements already described.

Figure 1:
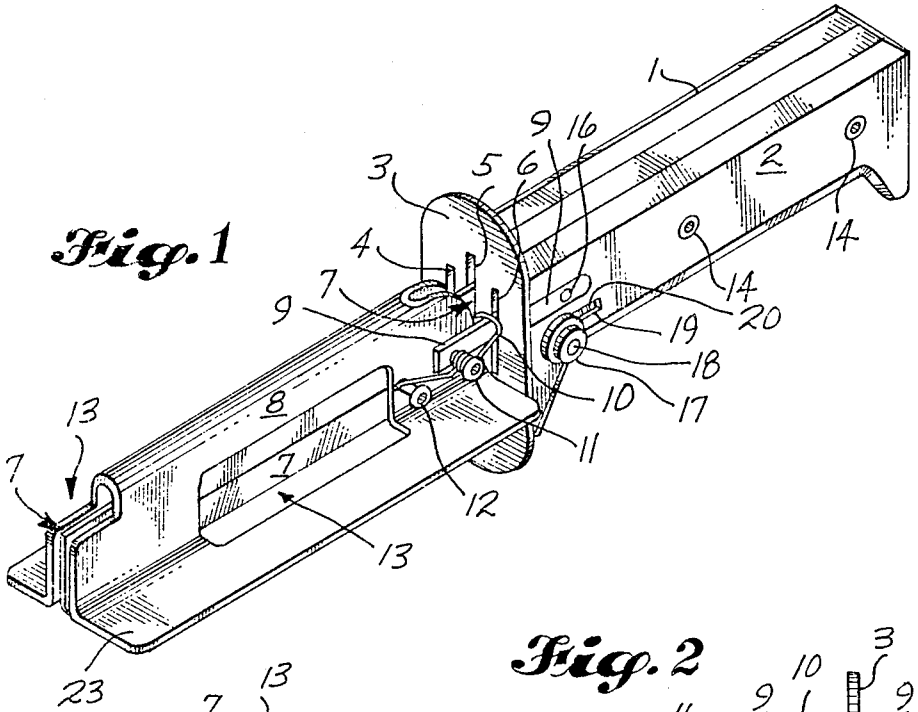
FIG. 1 is an isometric view of a first embodiment of the present safety honeycomb core cutting knife in accordance with the present invention. Illustrated is the handgrip, handshield assembly, safety guard assembly in the closed position (with flanges, viewing ports, spring, self-locking release assembly and guard flanges showing) and blade as visible through the top forward and left side viewing ports of the safety guard.
Figure 2:
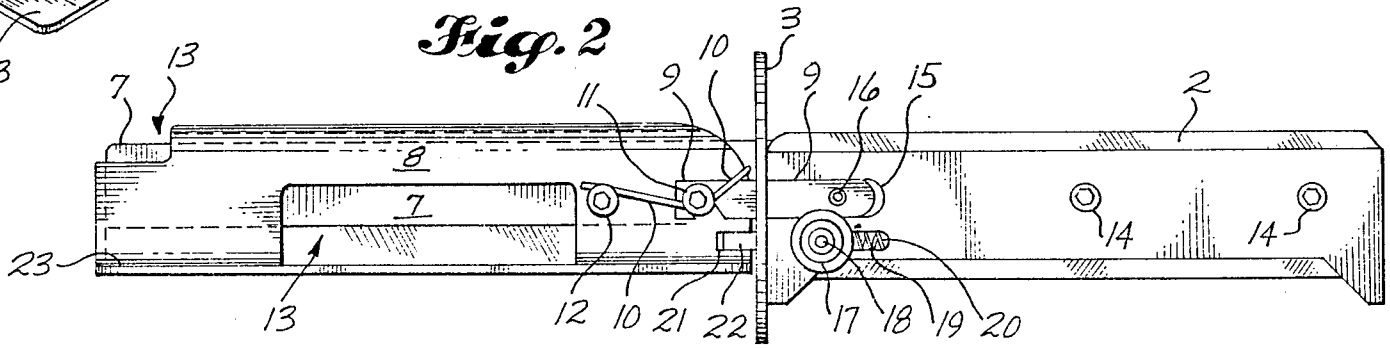
FIG. 2 is a side view of this embodiment, also in the closed position.
Figure 1A:
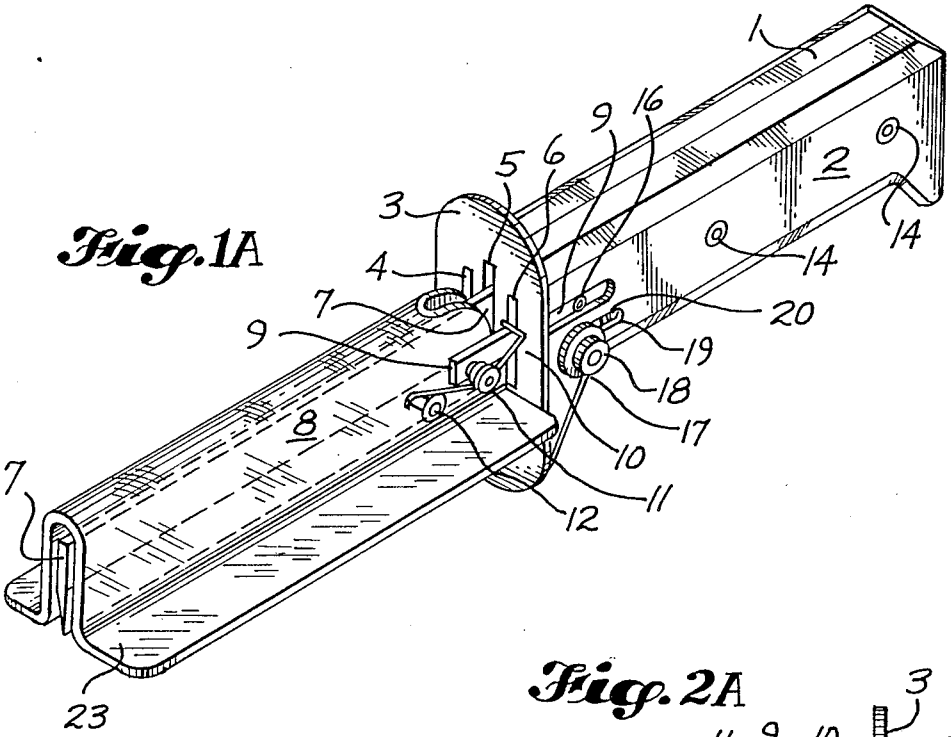
Figure 2A:
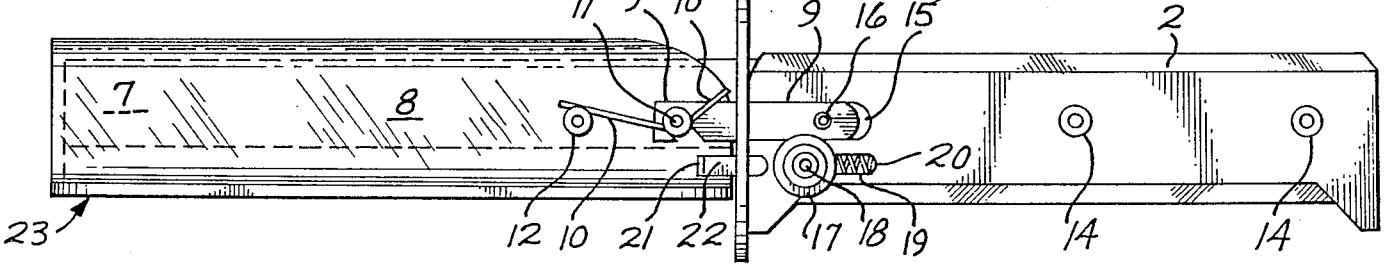
Figure 1B:
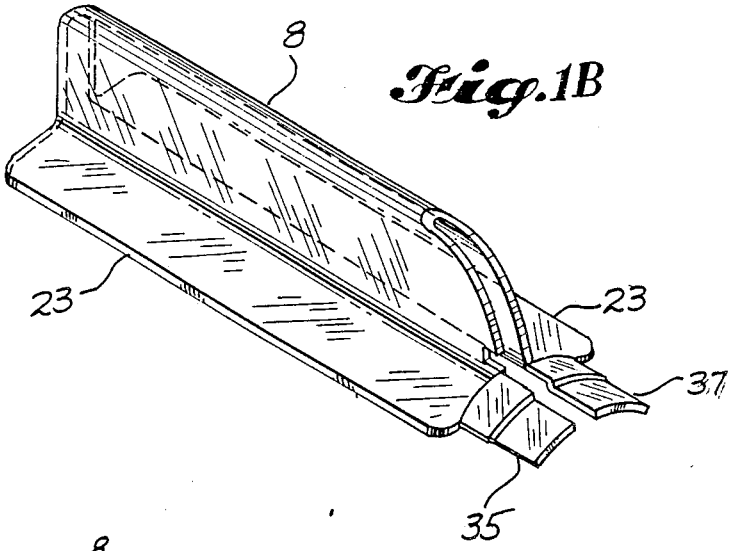
Figure 2B:
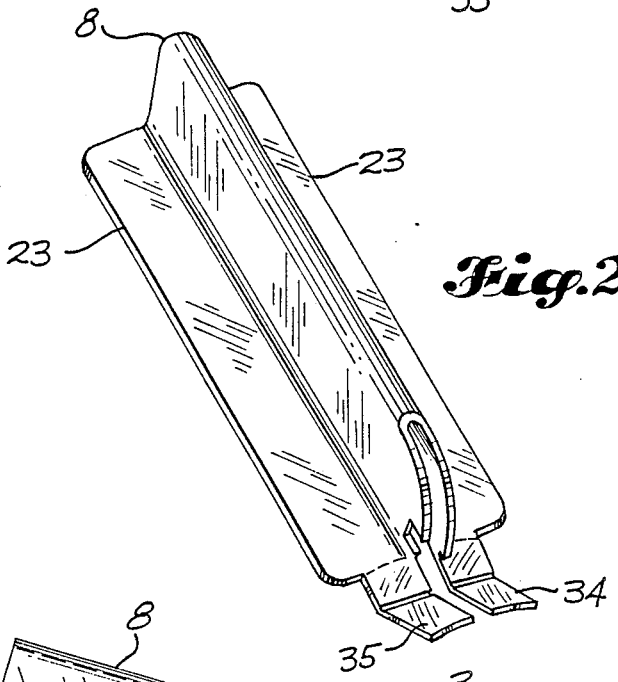
Figure 3B:
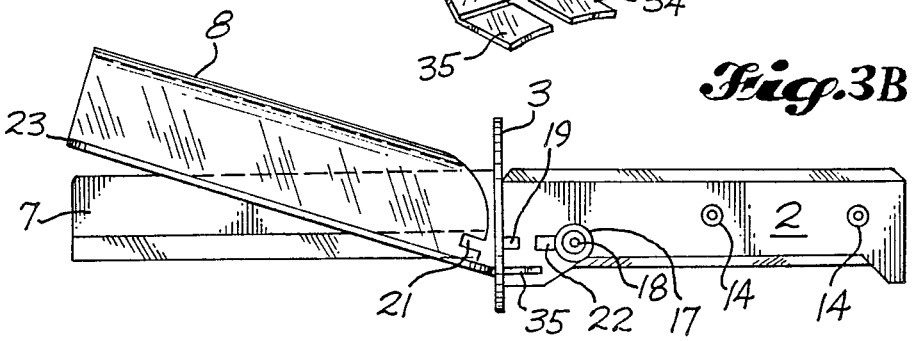
FIG. 3 is the same side view illustrating the guard in opened or released positions and the blade ready for cutting.

FIG. 1*b* is an isometric view of a fourth embodiment illustration of a transparent safety guard with integral hinge. As noted the hinge ends in tines which slip into specially molded lockable slots in the handgrip viewed in FIG. 3*b*. All springs and supports per embodiments 1 and 2 are subsequently removed;

FIG. 2*b* is another isometric view of this embodiment showing the hinge bent as would be the case were the knife actually in operation. Notice a slot for the self-locking release pin; and FIG. 3*b* is a side view illustrating the aforementioned features with the guard open as in actual operation.

DESCRIPTION OF THE PREFERRED EMBODIMENTS

Figure 7:
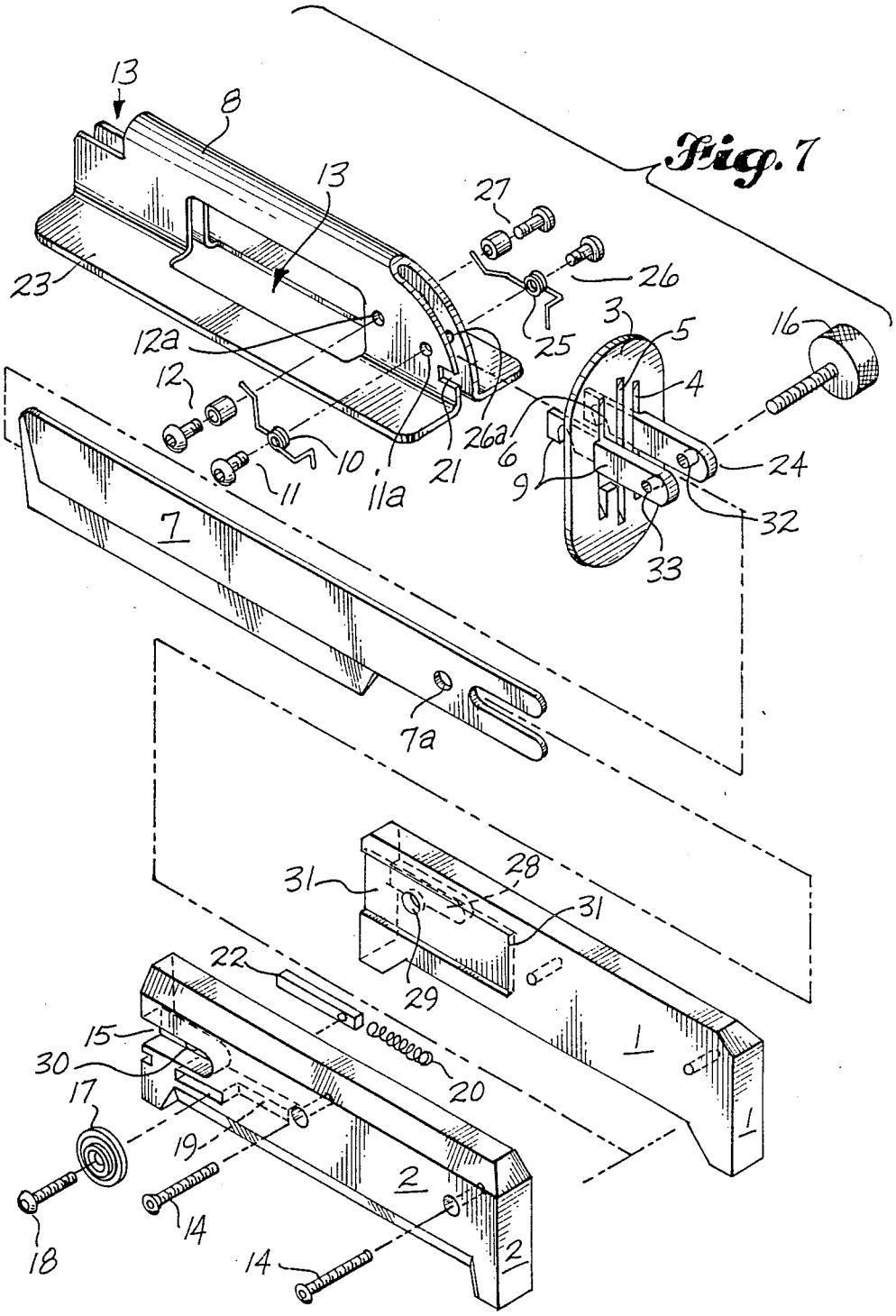
FIG. 7 is an exploded isometric view illustrating all component parts of this embodiment.
Figure 7A:
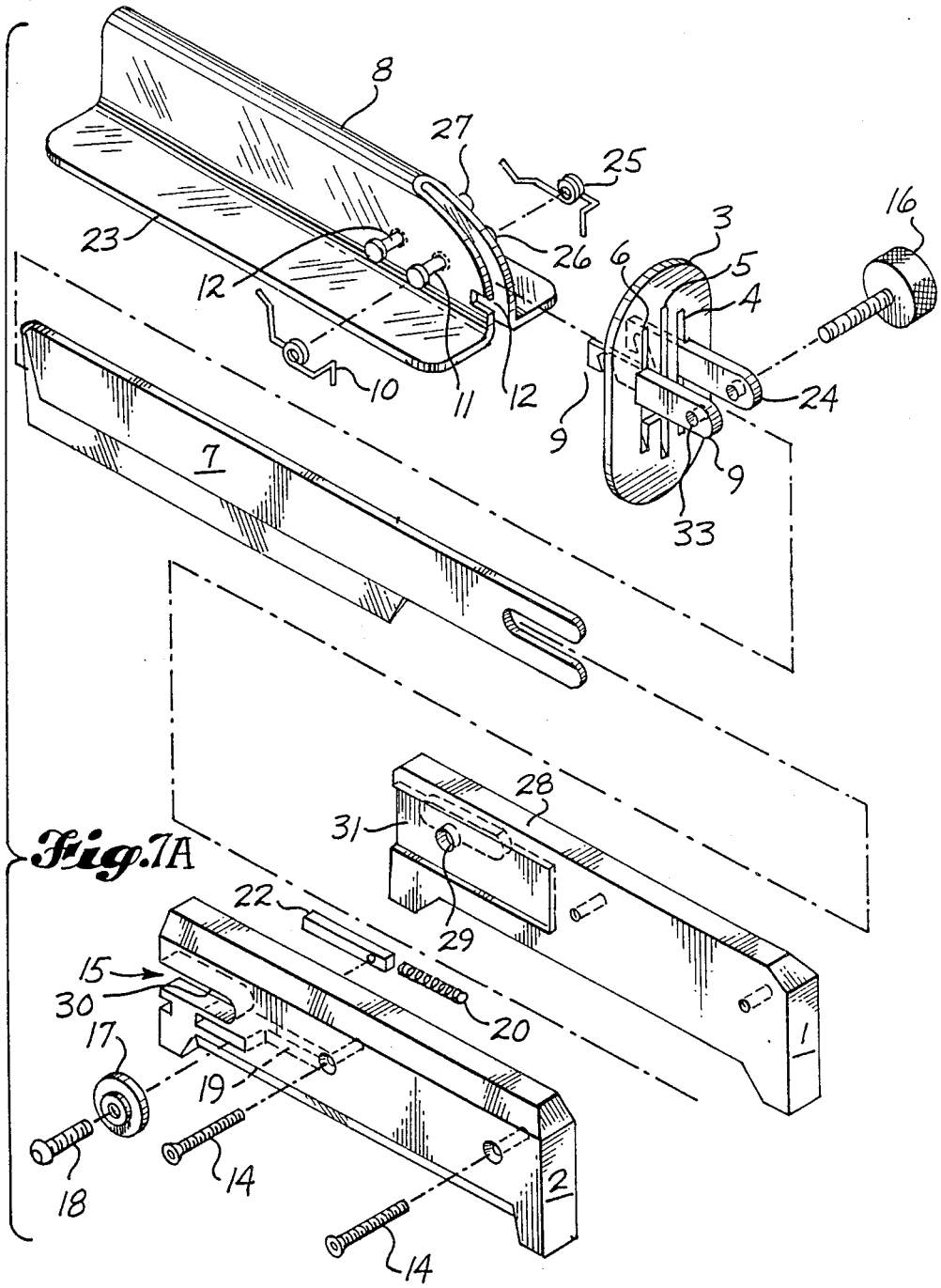

Turning now to FIGS. 1–7 of the first embodiment and FIGS. 1*a*–7*a* of the second embodiment of this invention, it is seen that the safety knife, herein disclosed, consists of a blade 7 of various forward configurations which may include straight edge, curved or pointed (which may comprise either plastic, ceramic, metal or a combination and may be of a throwaway or disposable type), handgrip halves 1 and 2, safety handshield assembly 3, automatically retractable safety guard assembly 8 with viewing ports 13, manually triggered self-locking release assembly 17 and threaded lock screw 16. Third and fourth embodiments are described hereinafter. In embodiments 1 and 2 of this invention, the aft end of the blade 7, blade slot 5 in the safety handshield 3 and blade cavity 31 in the handgrips (1 and 2) are aligned with each other as illustrated in FIGS. 7 and 7*a* such that the blade can fit through the aforementioned slot and be secured in the aforementioned cavity. Furthermore hole 7*a* in said blade is concentric with and dimensionally aligned with holes 29, 30, 32 and 33 of said handgrips (1 and 2) and tines (24 and 9) of said safety handshield 3 to accommodate threaded lock screw 16. Therefore, the blade may be continuous with a uniform cross section throughout its length, it may be necked down and with tines towards the aft end (as shown in FIGS. 7 and 7*a*), it may be necked down, only, or it may be continuous but ending in tines, only, as long as the aforementioned requirements are complied with. A working knowledge of the detailed assembly of preferred embodiments of the knife will enable a better understanding of its operation also hereinafter described. The mass components of embodiments 1 and 2 of this invention are assembled sequentially in the following steps:

Safety Guard Assembly

Fasten forward torsion spring supports and spacers 12 and 27 to the left and right sides of safety guard 8 through threaded holes 12*a* and 27*a*, respectively. Insert aft supports and spacers 11 and 26 through coils (facing upwards) of corresponding torsion spring 10 and 25 and fasten to left and right sides of safety guard 8 through threaded holes 11*a* and 26*a*, respectively.

Safety Handshield to Safety Guard Assembly

Raise aft ends of torsion springs 10 and 25, slip notched ends of tines 9 and 24 of safety handshield 3 over supports 11 and 26 and carefully lower aft ends of springs on them. Raise forward ends of springs carefully onto supports 12 and 27.

Figures 3, 4, 5, 6:
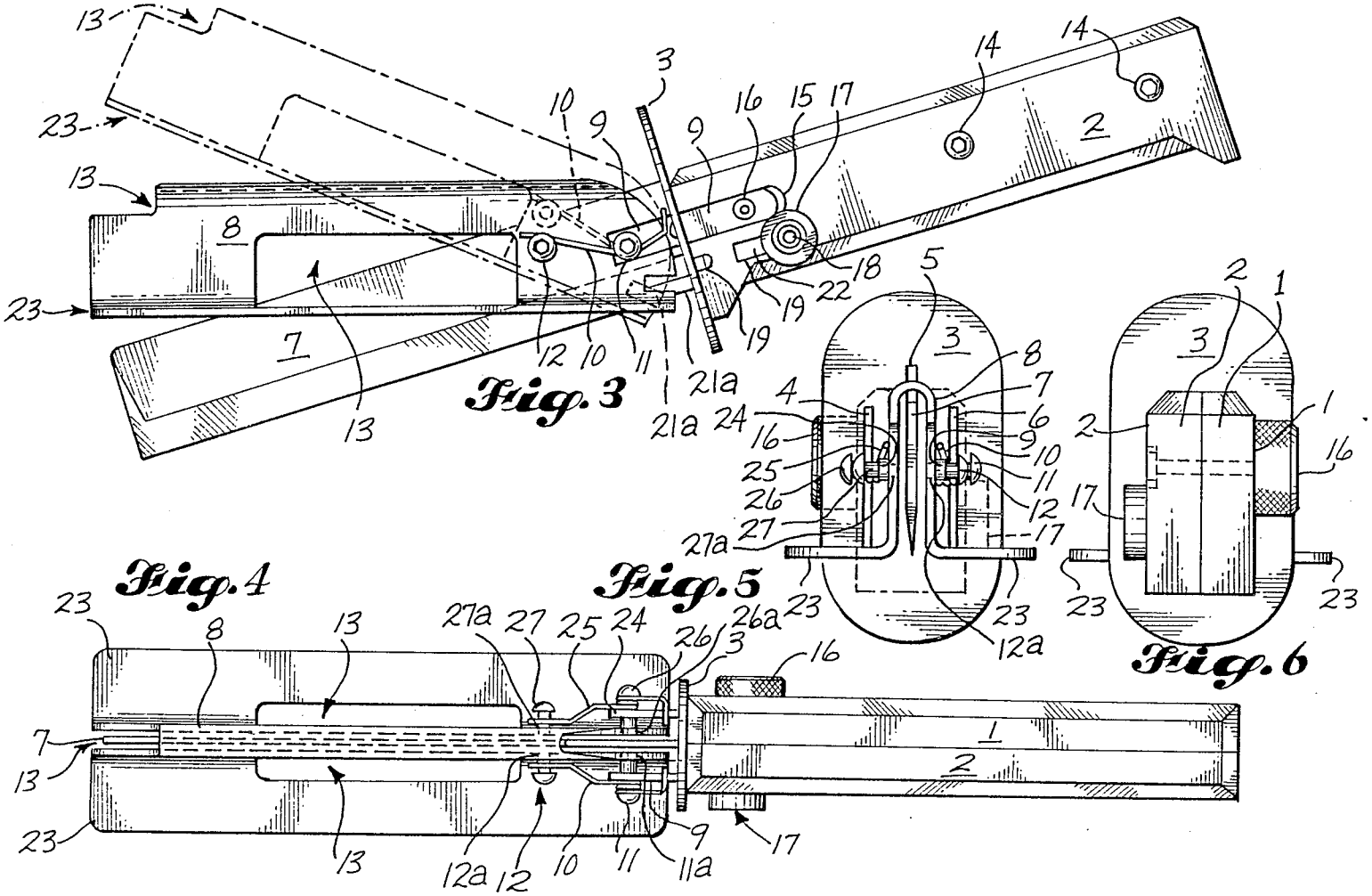
FIG. 4 is a plan view of this embodiment illustrating the handgrip (both halves), handshield, self-locking release assembly manual trigger, knurled blade lock screw, safety guard with spring mechanisms and blade (viewed through the top forward and aft ports in the safety guard)
FIG. 5 is a frontal view of the same embodiment.
FIG. 6 is an end view.
Figures 3A, 4A, 5A, 6A:
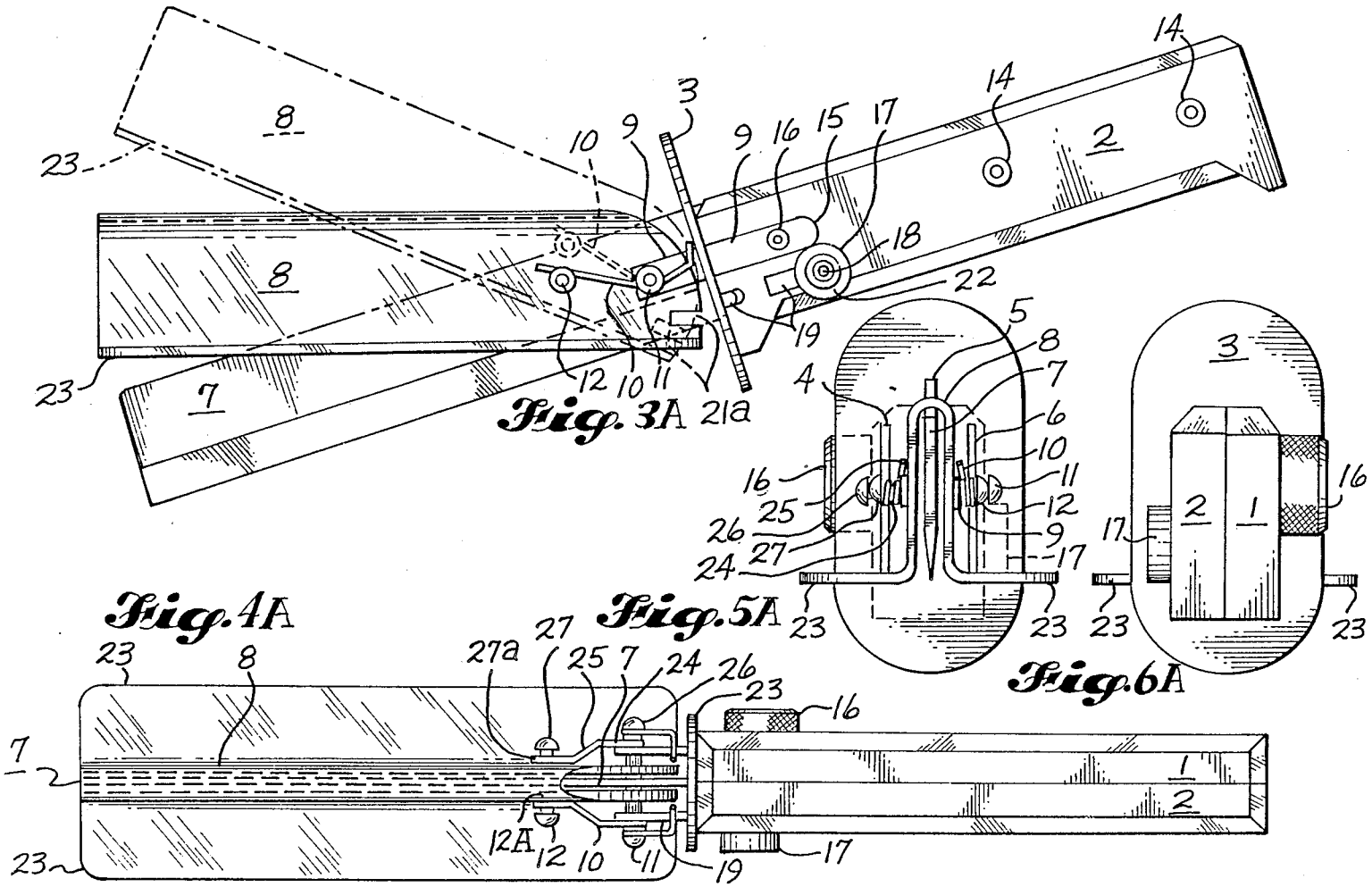

Handshield and safety guard are now attached together so that the guard is free to swivel laterally away from the blade exposing it as presented in FIG. 3 and to retract automatically.

Manually Triggered Self-Locking Release Assembly

Fasten locking pin 22 to coiled, spring 20. Insert the assembly into slot 19 of the left half of handgrip 2. Fasten the manual trigger 17 to the pin with attachment screw 18.

Join Handgrip/Safety Handshield and Safety Guard Assemblies

Fasten both halves of the handgrip 1 and 2 together by means of screws 14. Fasten the guard/shield assembly to the handgrip by slipping tines 9 and 24 into respective handgrip slots 15 and 28. Pivot the guard out of the way and then insert blade 7 through slot 5 of the shield 3 and then into its cavity 31 of the handgrip 1 and 2.

Insert threaded screw 16 through holes 32, 29, 7*a*, 30 and screwed into threaded hole 33.

All components including safety features are now in place, locked and ready for use. The desired line of cut on the workpiece is lined up through viewing ports 13. Activate the manual trigger 17, thus unlocking the safety guard 8 so that it will rise permitting cutting of the workpiece. As the blade 7 is removed from the workpiece, the guard automatically retracts covering the blade once more and is automatically locked shut by the self-locking release assembly.

The knife blade 7 may be sharpened without detaching the guard 8, or the blade may be removed for sharpening or replacement when needed or if a disposable blade is used by unscrewing the attachment screw 16 and removing the guard/handshield assembly as one unit. The knife blade cavity 31 in the handgrip is designed oversize with respect to the blade thickness as a means of preventing use of the knife without use of the safety features.

Proceeding now to the second embodiment of this invention the similarities (FIGS. 1*a*–7*a*) become obvious. A major difference is that the safety guard 8 is fabricated from transparent plastic. Examples of the plastic include but are not limited to acrylic (polymethyl methacrylate), polycarbonate, copolymer of polymethyl pentene which is solvent resistant as well. Fabrication is by injection molding, compression molding or any other compatible process. Using a transparent plastic eliminates the need for viewing ports in the guard. Clear vision of the blade and workpiece is always available.

A third embodiment of this invention includes substitution of many of the metal components in FIGS. 1–7 e.g. handgrips 1 and 2, safety self-locking release trigger 17, locking pin 22, handshield assembly 3 (including tines 9 and 24), and safety guard assembly 8 with plastic components manufactured via injection molding, compression molding or any other compatible process.

A fourth embodiment of this invention shown in FIGS. 1*b*–3*b* also includes plastic substitution for many of the metal components presented in FIGS. 1–7 of the first embodiment. The unique feature of this embodiment is the substitution of a transparent plastic guard 23 with integrally molded hinge 34 and 35 sometimes referred to as "living hinge". The properties of said plastic, e.g. polymethyl pentene are such that the integral hinge provides automatic retraction of the guard over the blade 7. This replaces the metal hinge consisting of springs, supports, spacers and holes, 10, 25, 11, 26, 12, 11*a*, 26*a*, 12*a*, and 27*a*. Handgrips 1 and 2 are modified to accept the integrally molded hinge 34 and 35 in embodiment 4.

What is claimed is:

1. A safety knife comprising in combination:

a handle;

a blade;

a safety guard assembly for covering said blade when not exposed for use, said safety guard assembly locked into position covering said blade when not exposed for use;

said safety guard assembly comprising a transparent or translucent plastic material and including an integral hinge;

means for automatically retracting said safety guard assembly to a rest position upon removal of said blade from a workpiece thereby preventing contact of the blade with the hand of an operator; and, wherein said safety guard assembly includes integral flanges flat or curved upward at forward end.

* * * * *